US005358423A

United States Patent [19]

Burkhard et al.

[11] Patent Number: 5,358,423

[45] Date of Patent: Oct. 25, 1994

[54] CONNECTING CLIP

[75] Inventors: Christopher J. Burkhard, Austin; Daryl A. Ramm, Cedar Park, both of Tex.

[73] Assignee: Minnesota Mining and Manufacturing Company, St. Paul, Minn.

[21] Appl. No.: 158,683

[22] Filed: Nov. 24, 1993

[51] Int. Cl.[5] ..... H01R 4/26

[52] U.S. Cl. ..... 439/402; 439/938; 439/100; 439/403; 403/394; 24/336

[58] Field of Search ..... 439/397, 401, 403, 396, 439/399, 100, 402, 786, 787, 907, 938; 403/394, 396, 399; 24/335, 336, 338, 339; 174/87, 94 R

[56] References Cited

U.S. PATENT DOCUMENTS

| | | | |
|---|---|---|---|
| 3,553,094 | 1/1971 | Scott, Jr. et al. | 204/197 |
| 3,778,951 | 12/1973 | Oroschakoff | 52/646 |
| 3,863,416 | 2/1975 | Oroschakoff | 52/646 |
| 4,127,312 | 11/1978 | Fleischhacker et al. | 439/403 |
| 4,855,024 | 8/1989 | Drachnik et al. | 204/147 |
| 5,009,612 | 4/1991 | Rishworth et al. | 439/403 |
| 5,199,899 | 4/1993 | Ittah | 439/403 |

*Primary Examiner*—Gary F. Paumen

*Attorney, Agent, or Firm*—Gary L. Griswold; Walter N. Kirn; John C. Barnes

[57] ABSTRACT

A clip for forming an electrical and mechanical connection at the junction of two rods to afford cathodic protection for said rods. The clip is electrically conductive and can have a sacrificial metal coating or metal insert.

17 Claims, 3 Drawing Sheets

CONNECTING CLIP

BACKGROUND TO THE INVENTION

1. Field of The Invention

This invention relates to connecting clips which are used in the formation of junctions for elongate reinforcing members, such as metal rod and reinforcing members, to form extended grids. These grid may be provided with means for cathodic protection which restricts corrosion and increases the useful life of reinforced concrete structures by stabilizing the metal grid.

2. Description of The Related Art

Metal rods in the form of a grid structure have long been used as internal reinforcement for concrete structures, such as beams, girders, columns, support surfaces and the like. These concrete forms are frequently subject to weakening due to the gradual deterioration of the reinforcing metal grid. Deterioration of the grid occurs because most metals, exposed to natural environments without protection, enter into reaction with constituents in the environment. This reaction results in the formation of corrosion products typical of the ores from which the metals were originally formed. Thus constituents, present in concrete, will attack the metal reinforcing structure, especially in the presence of moisture and soluble salts. This phenomenon may also be referred to as electrochemical corrosion. Since moisture is readily absorbed by concrete, it is necessary to provide a means of protection for the metal reinforcement. Two such means are regularly practiced. The first involves the deposition or formation of a protective coating on the surface of the metal rod which is used to form the grid structure. Coatings applied to rods are effective in protecting them from environmental attack. Unfortunately, damage of the coating is common and results in voids, cuts or scratches which allow access to the metal causing it to dissolve via electro-chemical corrosion. The dissolution of a metal in a liquid environment occurs at discrete sites which act as anodes. A corrosion cell consists of an anode and a cathode in contact with each other and with a common electrolyte. The metal forming the anode will dissolve while the cathode remains intact. It is necessary, therefore, to provide means whereby the metal to be protected becomes the cathode under conditions of corrosion cell formation. There are several ways of doing this. The most commonly used method is to attach a sacrificial anode to the metal to be protected. This method relies upon a characteristic electromotive force (EMF) which controls the tendency of a given metal to corrode. If two metals are connected through an external conductor and there is provision for a continuous electrolyte, the metal with the lower EMF will corrode.

An alternate means of cathodic protection is impressed-current cathodic protection (ICCPS). In this case the negative terminal of a DC power source is connected to the metal grid and the positive terminal is connected to a suitable anode adjacent to the reinforced structure. This arrangement establishes an electrical bias by which the reinforcing grid becomes the cathode upon formation of a corrosion cell.

U.S. Pat. No. 3,553,094 (I. C. Scott Jr.) discloses a device which may be strapped onto a coated pipe to provide a metallic component which preferentially becomes the anode during electrolytic cell formation in the presence of moisture. Penetration of the protective coating of the pipe occurs during tightening of the device against the pipe. Sharp projections, in contact with the protective pipe coating, cut through the coating and penetrate the metal surface to provide metal-to-metal, electrical connection to the pipe. A sacrificial anode, attached to the device, will be preferentially consumed, via electrochemical action, leaving the metal pipe intact.

Another form of sacrificial anode is revealed in U.S. Pat. No. 4,855,024 (Drachnik et al). In this case the anode is produced in the form of a mesh. The mesh is constructed of elongate electrodes held together at points of intersection or junctions by resilient conductive clips which secure and electrically connect the elongate electrodes. When suitably connected to e.g. a reinforcing grid of steel the mesh anode will protect the steel grid from corrosion. Protection is achieved by connecting the steel grid to a mesh anode positioned at the surface of the concrete form or embedded in concrete closely proximate the grid.

The properties and form of the resilient conductive clips, used to develop and stabilize the mesh anode, are selected to provide long term, optimum connection at the junctions.

Methods involving the use of clips to form grid networks are disclosed in U.S. Pat. Nos. 3,778,951 and 3,863,416 (both by G. Oroshakoff). In neither case is consideration given to corrosion protection of the metal rods used to form grids of the invention.

Study of the prior art has not revealed any concept which provides protective coating and cathodic protection combined with ease of assembly of metallic grids using connecting clips of this invention.

SUMMARY OF THE INVENTION

The present invention utilizes a connecting clip which is designed to accommodate two pieces of steel rod. Such a clip for connecting elongate reinforcing members comprises,

- a rectangular plate having opposite surfaces, opposite side edges and opposite end edges,
- a side tab affixed to and extending from each of the opposing side edges perpendicular to one of the surfaces of the rectangular plate,
- an end tab affixed to and extending from each of the opposing end edges perpendicular to the same surface of the plate but extending further than the side tabs, with each of the side tabs and each of the end tabs having a U-shaped contact element formed in the free end thereof which provides means for making resilient mechanical contact with elongate reinforcing members.

With sufficient connecting clips and multiple lengths of e.g. steel rod, it is possible to construct a matrix or grid wherein the connecting clips hold rods together at intersections or junctions with each other. Once formed, this grid is useful as a means of reinforcement for load bearing structures such as concrete forms. It is also within the scope of this invention to construct grids of steel rod of circular cross-section or tubes of suitable dimensions.

In the case of the present invention it is advantageous to form electrically conductive pathways integrally to the reinforcing grid. This facilitates cathodic protection when clips of the invention include a preformed insert of a sacrificial anode or are coated with a layer of metal which acts as an anode upon formation of a corrosion cell. Alternatively, impressed current cathodic protection, as previously described, may be applied to the electrically conducting grid.

The electrically conductive grid may be formed using either coated or uncoated steel rod. Since epoxy coated steel rods are electrically insulated, it is usually more difficult to establish electrical continuity throughout the grid. This problem is overcome by providing a surface irregularity, in the form of sharp projections or points, in combination with the electrically conducting connecting clip which is used to connect the rods at points where they intersect. The sharp projections abrade or penetrate the protective coating sufficiently to allow electrical contact to occur.

Each connecting clip accommodates two pieces of steel rod, in U-shaped recesses in orthogonal relationship, placed one adjacent to the other e.g. an upper rod is positioned at right angles to a lower rod. Thus a layer of parallel rods, side-by-side, with connecting clips at fixed positions, is equipped to receive a similar array of parallel rods, at right angles to the first. Attachment of the second layer adjacent to the first layer results in the formation of a rigid electrically connected metallic grid.

A pedestal support may be attached to the base of each connecting clip. With adjustment of the height of the support, it is possible to position the metallic grid in an optimum position for reinforcement, prior to encasing it in concrete or other construction material requiring reinforcement from the rods.

DESCRIPTION OF THE FIGURES

The invention is illustrated in the accompanying drawing wherein.

DETAILED DESCRIPTION OF THE INVENTION

Figure 1:
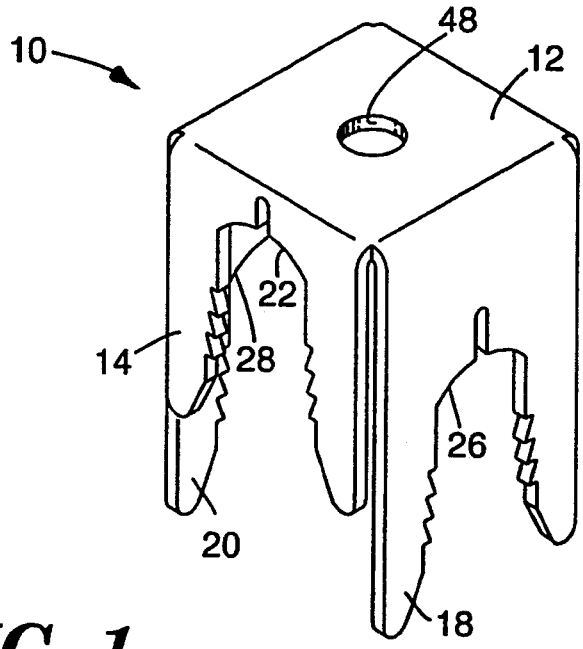
FIG. 1 is a perspective view of a connecting clip of the invention.

The invention will be described with reference to the drawing wherein like reference numerals refer to like parts throughout the several views.

Figure 4:
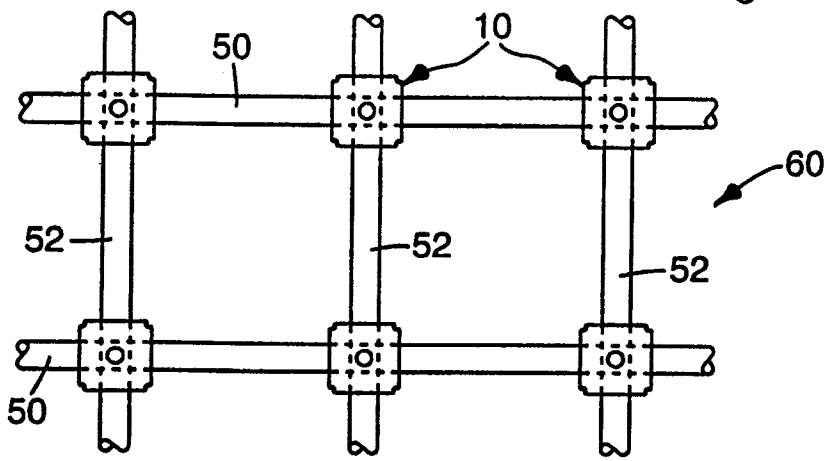
FIG. 4 is a plan view of a grid of elongate members connected at overlapping junctions by connecting clips of the present invention.

FIG. 1 shows a connecting clip according to the present invention. This clip is used in developing a network of reinforcing rods as shown in FIG. 4. The connecting clip 10 is made of highly resilient material such as stainless steel. It comprises a rectangular plate 12 to which opposed side tabs 14 and 16 are affixed and extend perpendicular to the plate 12. In similar fashion, opposed end tabs 18 and 20 are affixed to and extend perpendicularly from plate 12, illustrated as a square. The end tabs 18 and 20 of the connecting clip 10 are of equal length but longer than the side tabs 14 and 16 which extend an equal distance from the surface of the square plate 12. The distal or free ends of each of the side tabs 14 and 16 and each of the end tabs 18 and 20 have a U-shaped recess forming a contact element 22,24,26 and 28 respectively, therein.

Figure 2:
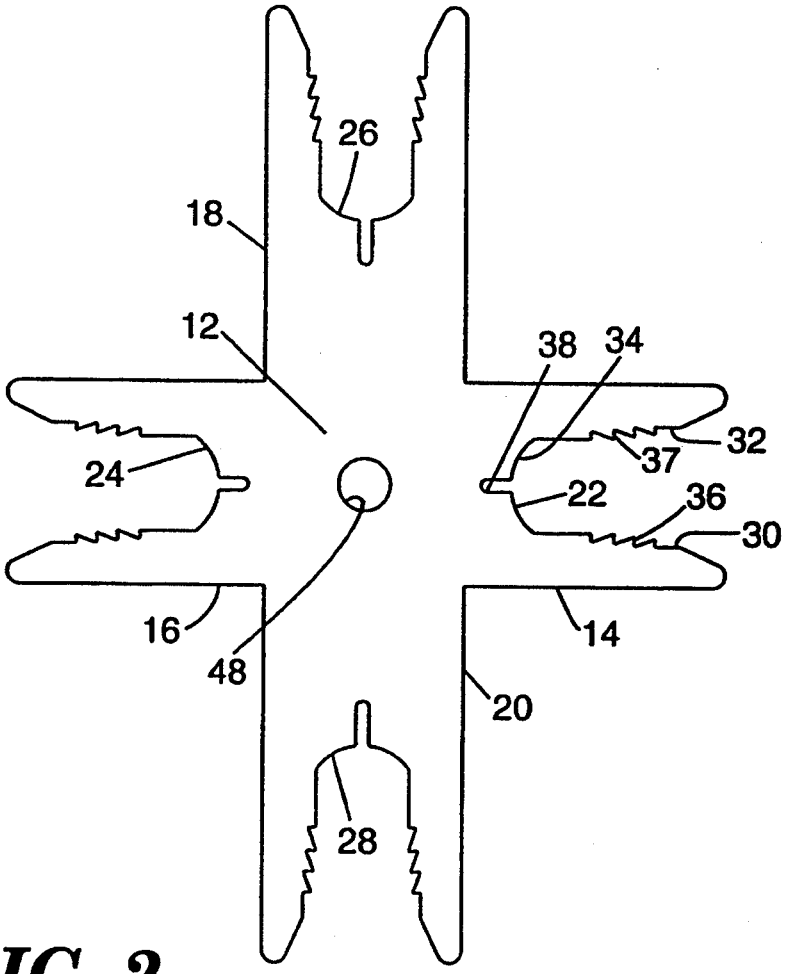
FIG. 2 is a plan view of a pattern used to form the electrically conducting clip.

Connecting clip 10 may be formed from a single metal pattern as depicted in FIG. 2. which structure is in the general shape of a cross. The central portion, which connects the limbs of the cross, is square plate 12 of FIG. 1 having extensions 14,16,18 and 20 respectively attached to each of its four sides. Bending of each of the extensions downwards until a vertical relationship is established between an extension and the square plate 12 results in formation of the connecting clip 10 previously described. A hole 48 at the center of the metal pattern is provided as a point of connection between a formed clip and an upper end portion of a pedestal support.

FIG. 2 also provides a detail view of the U-shaped contact element 22 of side tab 14 which has an open end portion opposing side walls 30 and 32 and a closed portion 34 generally describing a U-shaped recess. The opposing side walls 30 and 32 of the contact element 22 are each provided with at least one serration 36 and 37 as a means of abrading coatings or oxide from the rods which are pressed into position between the opposing side walls 30 and 32 of each contact element. As illustrated, the abrading means are in the form of stepped teeth to progressively cut through the coatings or oxides on the rods. The incorporation of a longitudinal slot 38 in the closed portion 34 of the U-shaped recess, facilitates the resilient gripping action of the U-shaped contact element 22.

Figure 3:
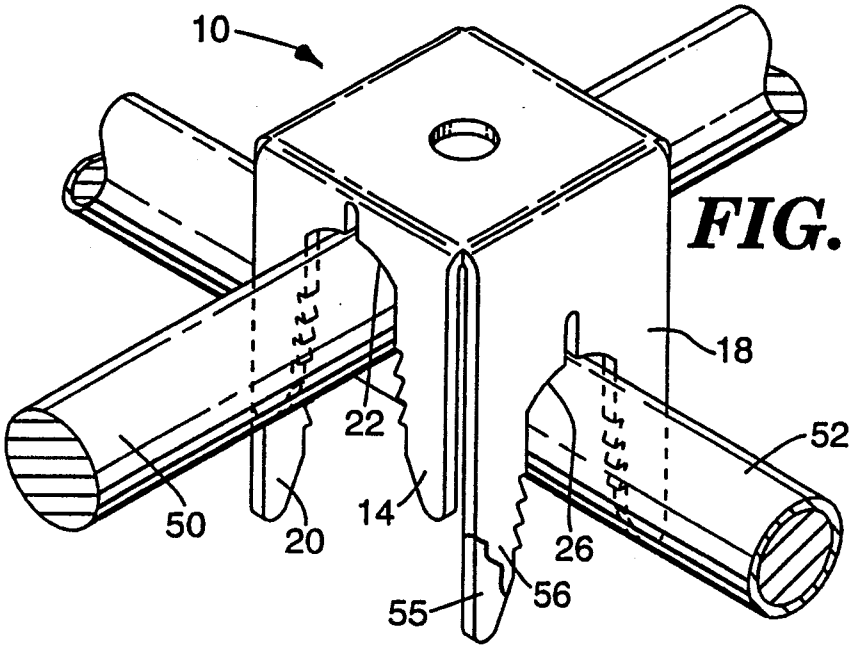
FIG. 3 is a perspective view of a junction formed from a connecting clip and first and second elongate members, partly broken away to illustrate a protective coating.

A junction may be formed between two sections of metal rod according to FIG. 3 using a clip of the invention. In this case the connecting clip 10 is applied over rod section 50 until it is firmly held between two U-shaped contact elements 22 and 24 of side tabs 14 and 16. In similar fashion rod section 52 is positioned between two U-shaped contact elements 26 and 28 in opposing end tabs 18 and 20. Rods forming the junction may be uncoated rod as shown by bare rod section 50 or coated rod as exemplified by insulated rod 52 or combinations thereof as shown. The formation of a plurality of junctions along sections of rod results in the metal grid 60 shown in FIG. 4.

Figure 5:
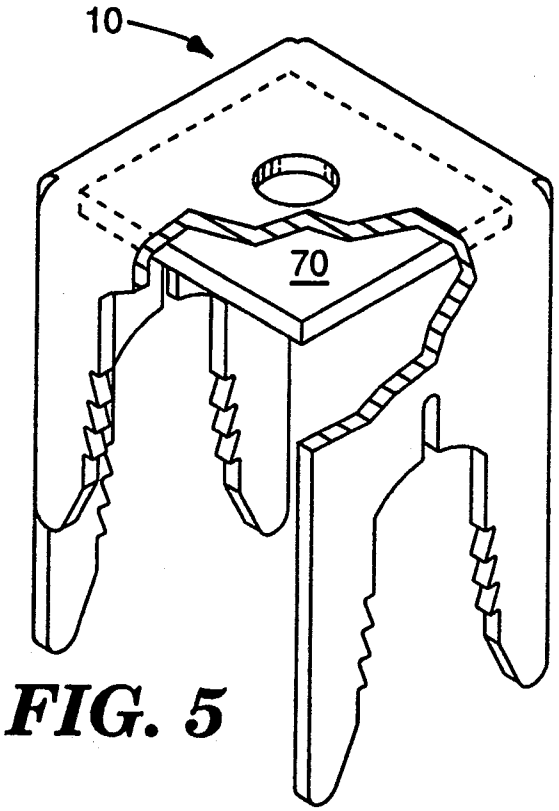
FIG. 5 is a detail view with a portion of the connecting clip, cut away to reveal cathodic protection means.

A metal grid may be cathodically protected by incorporation of an insert as a sacrificial anode 70 in the clip 10 according to FIG. 5. Alternatively, it is possible to plate the metal 55 of the clip 10 with the preferentially consumed sacrificial metal, as shown diagrammatically at 56 in FIG. 3. Suitable anode materials include zinc, aluminum and alloys thereof. This provides protective means at each junction.

While reinforcing grids are typically made from low-grade steel rod, the properties of the steel used for the cathodic protection clip 10 require careful selection of a metal which is sufficiently rigid and resilient for establishing secure, electrically conducting junctions between rods and for stabilizing the extended grid network. For this purpose it is necessary therefore to use electrically conductive, high strength metals and their alloys including copper, titanium, stainless steel and nickel-based alloys. A metal designated as 304 stainless steel is a preferred material for clips of this invention.

It has been demonstrated that electrically conducting connecting clips, made from 304 stainless steel, are effective for use with coated and uncoated metal rods. With uncoated rods the formation of electrically conductive junctions is relatively easy. The sharp projections on opposing side-walls of the U-shaped contact elements readily displace any oxide coating and easily penetrate the surface of the metal rod. When e.g. resin coated rod is used the penetrating power of the sharp projections 36 and 37 must be sufficient to cause metal-to-metal contact between the rod and the connecting clip 10. Failure to do this will result in junction formation without electrical continuity since most protective resin coatings are electrically insulating.

It has been shown that resin coated, electrically conducting grid structures are produced consistently using clips of the invention via the following test procedure:

Five sections of epoxy resin coated rod, 24" long and 0.625" in diameter were selected along with six (6) electrically conducting connecting clips of the invention. The rod was laid out on a horizontal surface forming two layers. A lower layer was formed of two rods positioned side-by-side in a parallel relationship. The remaining three rods were placed, side-by-side in parallel relationship to each other, across the two lower rods. Spatial arrangement of rods resulted in the formation of a regular square grid having six (6) junctions as presented in FIG. 4. Each junction was secured with a clip 10. A hammer was used to drive the clip around the junction. Without further adjustment an ohmmeter, checked several times by connecting between various points on the metal grid, indicated satisfactory electrical continuity throughout the grid.

Figure 7:
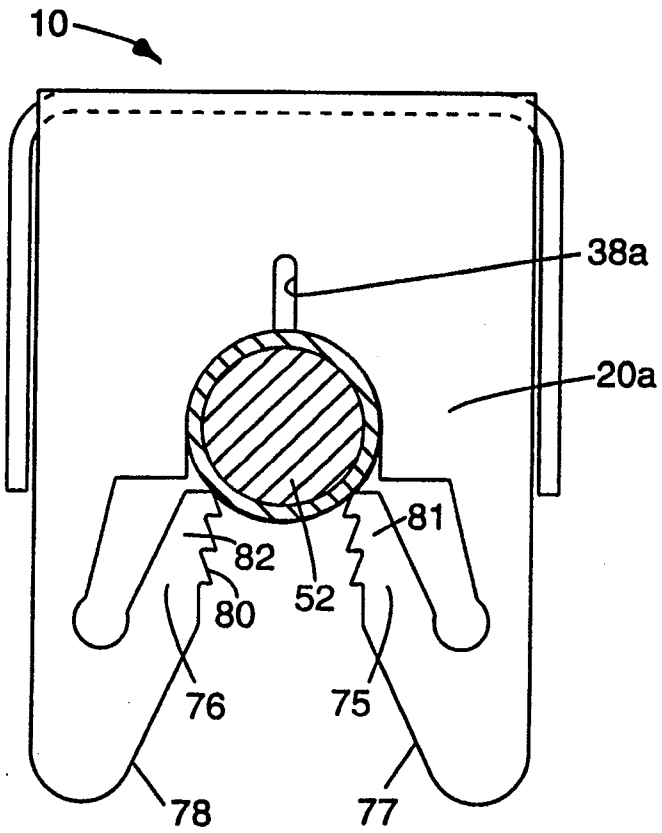
FIG. 7 is a end view of the clip of FIG. 6 illustrating the rod in position.

An alternative embodiment of the end tabs 18 and 20 for the clip 10 is illustrated in FIGS. 7 and 8. While this form may be used on the side tabs 14 and 15 as well, it is not necessary as this embodiment comprises means for maintaining the rod sections in the clip.

Figure 6:
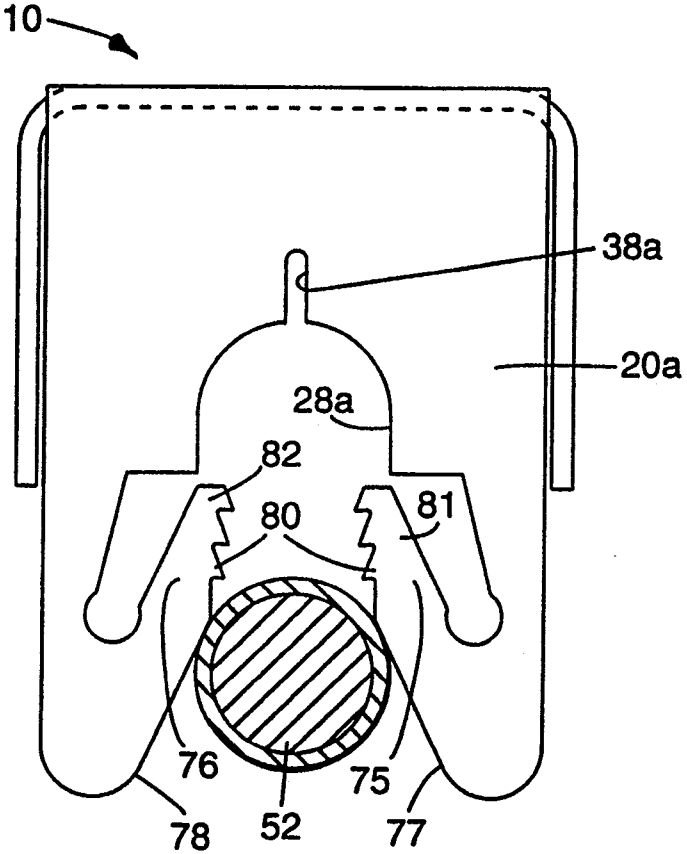
FIG. 6 is a end view of an alternative form of tab showing a rod being inserted.

As illustrated in these figures the end tabs 18 and 20, have the retaining arms. For purposes of description, the end tab will be identified as 20*a*, having a U-shaped contact element 28*a*, terminating with a slot 38*a*, and having a pair of resilient arms 75 and 76 positioned at the free ends of the tab 20*a* formed by cutting the U-shaped contact element 28*a*. The arms 75 and 76 have an elbow at the free end and the arms extend in a converging manner from the free end of the tab toward the U-shaped contact element 28*a*. The arms 75 and 76 have opposed surfaces 77 and 78 and terminate at ends spaced less than the opposing side edges defining the U-shaped contact element 28*a*. The opposed surfaces have serrations 80 thereon for progressively cutting through a coating or oxide formed on the rod 52. As illustrated in FIG. 6, the rod 52 enters the throat formed by the opposing surfaces 77 and 78 formed between the arms 75 and 76. Continued movement forces the rod into the serrations 80, causing an abrading of the coating or oxide. As illustrated in FIG. 7, the rod has been forced into the U-shaped contact element 28*a* and is clamped in electrical contact therein. The ends 81 and 82 of the arms 75 and 76 are spaced from the walls defining the U-shaped contact element, such that when they return toward their normal position, they lock the rod 52 in the contact element 28*a*.

The end tabs, when formed as illustrated, hold both of the transversely positioned rods in place as the rod 52 of the bottom layer traps the upper rod in the side tabs of the clip.

What is claimed is:

1. A clip for connecting elongate reinforcing members, said clip comprising:

a rectangular plate having opposite surfaces, opposite side edges and opposite end edges, a side tab affixed to and extending from each of said opposite side edges perpendicularly to one of said surfaces of said plate, an end tab affixed to and extending from each of said opposite end edges perpendicularly to said one said surface a distance greater than said side tabs, said side tabs and said end tabs each having a U-shaped contact element formed in the free end thereof, said contact element having means for making resilient mechanical contact with elongate reinforcing members whereby a junction can be formed of elongate members by applying a said clip to rigidly connect pairs of elongate reinforcing members.

2. A clip according to claim 1 wherein said clip is formed of conductive material.

3. A clip according to claim 2 wherein said conductive material is selected from the group consisting of copper, titanium, stainless steel or nickel alloys.

4. A clip according to claim 1 wherein said U-shaped contact element comprises wall means defining an open end portion with opposing side walls and an end wall generally describing a U-shaped recess, each of said side walls having at least one irregularity as means for abrading a member inserted into said open end portion.

5. A clip according to claim 4 wherein said means for abrading is at least one sharp projection.

6. A clip according to claim 4 wherein a longitudinal slot extends from said end wall closed portion opposite and away from said open end portion.

7. A clip according to claim 1, wherein said clip supports and is electrically connected to means for corrosion protection.

8. A clip according to claim 7 wherein said means for corrosion protection is a sacrificial anode of a base metal selected from the group consisting of zinc, aluminum or alloys thereof.

9. A clip according to claim 7 wherein said means for corrosion protection is a metallic coating deposited over the surface of said connecting clip said metallic coating comprising a base metal selected from the group consisting of zinc, aluminum or alloys thereof.

10. A clip according to claim 1 wherein an end tab is formed with retaining arms adjacent the opening leading into said U-shaped contact element.

11. A clip according to claim 10 wherein said retaining arms are formed at the face ends of said tab and are positioned in opposing relationship and are resiliently biased apart to insert a reinforcing member into said U-shaped contact element.

12. A clip according to claim 11 wherein said arms have serrations along opposed surfaces to abrade the edges of a said reinforcing member during insertion.

13. A junction of a grid formed by elongate reinforcing members comprising;

a clip for connecting said reinforcing members, said clip comprising;

a square plate having opposite surfaces, opposite side edges and opposite end edges;

a side tab affixed to and extending from each of said opposite side edges perpendicularly to one of said surfaces of said square plate;

an end tab affixed to and extending from each of said opposite end edges perpendicularly to said one said surfaces a distance greater than said side tabs, each said side tab and said end tab having a U-shaped contact element formed in the free end thereof, said contact element having means for making resilient mechanical and electrical contact with said elongate reinforcing members;

a first elongate reinforcing member positioned with its longitudinal axis parallel to said end edges of said square plate a portion of said first elongate member held by each of said U-shaped contact elements of said side tabs;

a second elongate reinforcing member positioned with its longitudinal axis parallel to said side edges of said square plate, a portion of said second elongate reinforcing member held by each of said U-shaped contact elements of said end tabs, with said first elongate member and said second elongate member overlapping in transverse relationship.

14. A junction according to claim 13 wherein said clip is formed of a conductive material.

15. A junction according to claim 13 wherein at least one of said elongate reinforcing members has a protective resin covering.

16. A junction according to claim 15, wherein said protective resin coating is an epoxy resin.

17. A method of forming a grid of elongate reinforcing members comprising the steps of:

forming an orthogonal array comprising a first layer and a second layer of said elongate reinforcing members with each of said elongate reinforcing members positioned in parallel side by side relationship within each of said first layer and said second layer, said members of said first layer being disposed at right angles to said members forming said second layer, and connecting said first layer to said second layer at a plurality of points of intersection between said members using a clip comprising a rectangular plate having opposite surfaces, opposite side edges and opposite end edges, a side tab affixed to and extending from each of said opposite side edges perpendicularly to one of said surfaces of said plate, and an end tab affixed to and extending from each of said opposite end edges perpendicularly to said one said surface a distance greater than said side tabs, said side tabs and said end tabs each having a U-shaped contact element formed in the free end thereof, for making resilient mechanical contact with said elongate reinforcing members, each said clip connecting a portion of an elongate reinforcing member from said first layer to a portion of an elongate reinforcing member from said second layer at a said point of intersection such that said U-shaped contact element of each of said side tabs is in resilient mechanical contact with said portion of said elongate member from said first layer and said U-shaped contact element of each said end tab is in resilient mechanical contact with said portion of said elongate member from said second layer.

* * * * *